US011415911B1

(12) United States Patent
Josiah et al.

(10) Patent No.: US 11,415,911 B1
(45) Date of Patent: Aug. 16, 2022

(54) METHOD FOR CONVERTING DEVELOPER IN A PRINTER CARTRIDGE

(71) Applicant: UI Technologies, Inc., Hawthorne, CA (US)

(72) Inventors: Michael Raymond Josiah, North Patchogue, NY (US); Joseph Dovi, Lake Grove, NY (US)

(73) Assignee: UI Technologies, Inc., Hawthorne, CA (US)

( * ) Notice: Subject to any disclaimer, the term of this patent is extended or adjusted under 35 U.S.C. 154(b) by 0 days.

(21) Appl. No.: 17/238,821

(22) Filed: Apr. 23, 2021

(51) Int. Cl.
*G03G 15/08* (2006.01)

(52) U.S. Cl.
CPC ..... *G03G 15/0887* (2013.01)

(58) Field of Classification Search
CPC ..... G03G 15/0887
See application file for complete search history.

(56) References Cited

U.S. PATENT DOCUMENTS 9,383,684 B1 7/2016 Josiah
2007/0223948 A1* 9/2007 Matsui ..... G03G 15/0848 399/27
2008/0138117 A1* 6/2008 Wegman ..... G03G 15/0822 399/253
2009/0080913 A1* 3/2009 Suzuki ..... G03G 15/0853 399/30
2018/0052421 A1* 2/2018 Josiah ..... G03G 15/0121
2018/0275589 A1 9/2018 Josiah

OTHER PUBLICATIONS

European Patent Office, European Search Report, dated Jan. 1, 2022, 7 pages, United States.

* cited by examiner

*Primary Examiner* — Walter L Lindsay, Jr.
*Assistant Examiner* — Geoffrey T Evans
(74) *Attorney, Agent, or Firm* — Kevin Schraven; Anooj Patel; Hankin Patent Law, APC

(57) ABSTRACT

A method of converting developer in a printer cartridge, comprising the steps: providing a developer unit of a printer cartridge; removing a first mixture of a developer and a first toner from the developer unit; sieving the first mixture of the developer and the first toner; removing the first toner from the first mixture of the developer and the first toner; mixing a second toner to the developer to create a second mixture of the developer and the second toner, wherein the second toner is a different toner than the first toner; and adding the second mixture of the developer and the second toner into the developer unit of the printer cartridge.

20 Claims, 4 Drawing Sheets

METHOD FOR CONVERTING DEVELOPER IN A PRINTER CARTRIDGE

FIELD OF USE

The present disclosure relates generally to printer cartridge developer and/or toner replacement. More specifically, this disclosure relates to methods and systems of converting developer in a printer cartridge. The present disclosure is directed to both reusing the existing developer of a printer or printer cartridge or replacing the existing developer with a new developer.

BACKGROUND

In traditional overprint machines, toner and drums are not able to be swapped because they are in a printer cartridge that has developer. Thus, there is a general inability to change the printing style and colors of that type of printer cartridge. Because of this, different machines need to be purchased for different tasks instead of being able to use a single machine for many tasks. This leads to inefficiency and significant expense.

Thus, there is a need for a system and method for converting developer in a printer cartridge.

SUMMARY OF EMBODIMENTS

To minimize the limitations in the cited references, and to minimize other limitations that will become apparent upon reading and understanding the present specification, the developer conversion methods disclosed herein preferably allow a user to convert developer color or style.

In various embodiments, the methods and systems may be used to convert a developer mixed with a first toner in printing cartridge(s) and/or drum(s) printing machine to a printing machine that prints with a developer mixed with a second toner.

The embodiments of the present disclosure provide a method of converting developer in a printer cartridge. The method comprises the steps: providing a developer unit of a printer or printer cartridge; removing a first mixture of a developer (carrier) and a first toner from the developer unit; sieving the first mixture of the developer and the first toner; removing the first toner from the first mixture of the developer and the first toner; mixing a second toner with the developer to create a second mixture of the developer and the second toner, wherein the second toner is a different toner than the first toner; and adding the second mixture of the developer and the second toner into the developer unit of the printer or printer cartridge.

Consistent with some embodiments, the present disclosure also provides a method that comprises the steps: providing a developer unit of a printer cartridge (laser or LED); removing a first mixture of a developer and a first toner from the developer unit; removing a developer cover from the developer unit; sieving the first mixture of the developer and the first toner; removing the first toner from the first mixture of the developer and the first toner; mixing a second toner with the developer to create a second mixture of the developer and the second toner, wherein the second toner is a different toner than the first toner; adding the second mixture of the developer and the second toner into the developer unit of the printer cartridge (laser or LED); and replacing the developer cover onto the developer unit.

Consistent with some embodiments, the present disclosure also provides a method that comprises the steps: providing a developer unit of a printer cartridge; removing a first mixture of a first developer and a first toner from the developer unit; providing a second developer; mixing a second toner with the second developer to create a second mixture of the second developer and the second toner, wherein the second toner is a different toner than the first toner; and adding the second mixture of the developer and the second toner into the developer unit of the printer cartridge.

Consistent with some embodiments, the present disclosure also provides a method that comprises the steps: providing a developer unit of a toner printer; removing a first mixture of a first developer and a first toner from the developer unit; separating and removing the first toner out of the first mixture, such that a separated developer is created; mixing a second toner with the separated developer to create a second mixture of the separated developer and the second toner, wherein the second toner is a different toner than the first toner; and adding the second mixture of into the developer unit of the toner printer.

Other features and advantages inherent in the system and method for converting a printer cartridge into as claimed and disclosed will become apparent to those skilled in the art from the following detailed description and its accompanying drawings.

It is to be understood that both the foregoing general description and the following detailed description are exemplary and explanatory only and are not restrictive of the disclosed embodiments, as claimed.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

Figure 1:
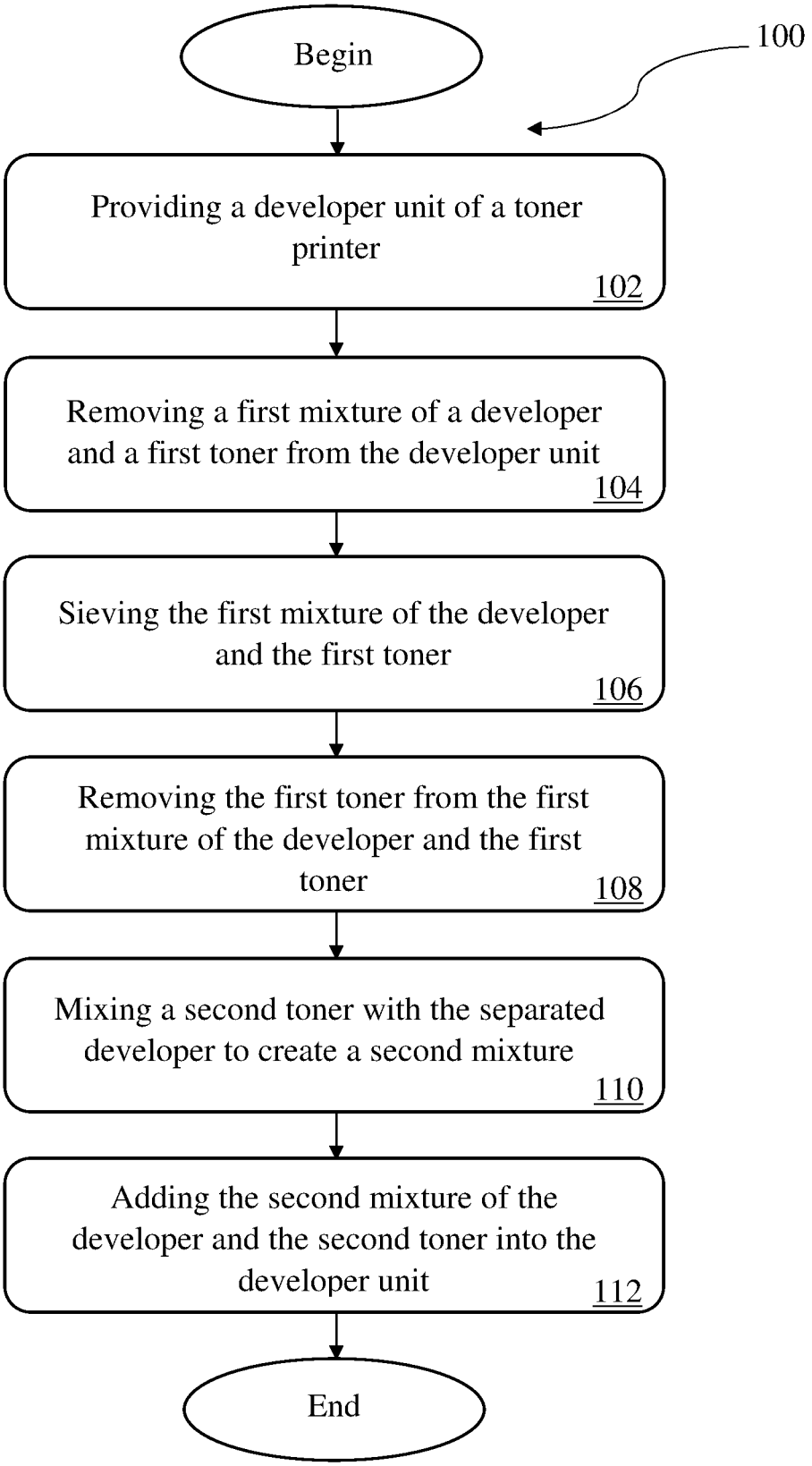
FIG. 1 illustrates a flowchart of an exemplary method for converting developer in a printer cartridge, consistent with some embodiments of the disclosure.

In the following detailed description, numerous specific details are set forth in order to provide a thorough understanding of various aspects of one or more embodiments. However, these embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 15% of the indicated number or range of numbers. In one embodiment, the term "approximately" and "about", refer to a deviance of between 0.0001-40% from the indicated number or range of numbers.

In the following description, certain terminology is used to describe certain features of one or more embodiments. For purposes of the specification, unless otherwise specified, the term "printer cartridge(s)" and "printing cartridge(s)" generally refers to a toner printer cartridge, a laser printer cartridge, a LED printer cartridge, a drum cartridge, and/or a combined toner and drum printer cartridge. In some cases, a printer may not have an entirely separable printer cartridge, in which case, the printer cartridge may refer to the printer itself or a portion of the printer that is dedicated to performing the task of a printer cartridge.

As used herein, the term "toner" generally refers to a powder, particulate, or dry ink that is used in toner printers (laser or LED (light emitting diodes)), printers, printer cartridges, and printing machines to form the printed text and images on the medium being printed. Generally, toner particles are melted by the heat of a fuser and are bound to the media.

As used herein, the term "developer" generally refers to metal filings, commonly known as carrier but also refers to the mixture of such carrier and toner. Although developer tends to refer only to the mixture of metal filings and toner, herein developer comprises either the carrier by itself or in combination with the toner. The term "separated developer" refers to developer metal filings that are not mixed with toner or that is substantially toner free. Separated developer may also refer to carrier that has never before been mixed with toner.

The present specification discloses a system and method for converting developer in a printer cartridge. The present method and system for converting developer in a printer cartridge may allow the conversion of: (1) one color of regular toner to another color, especially when using an overprinting machine where toner and drum swapping is note possible, (2) standard toners to dye sublimation toners, and (3) standard toners to fluorescent toners. The method may also be used for reversing any of the mentioned processes.

FIG. 1 is a flowchart of an exemplary method 100 for converting developer in a printer cartridge, consistent with some embodiments of this disclosure.

Figure 2:
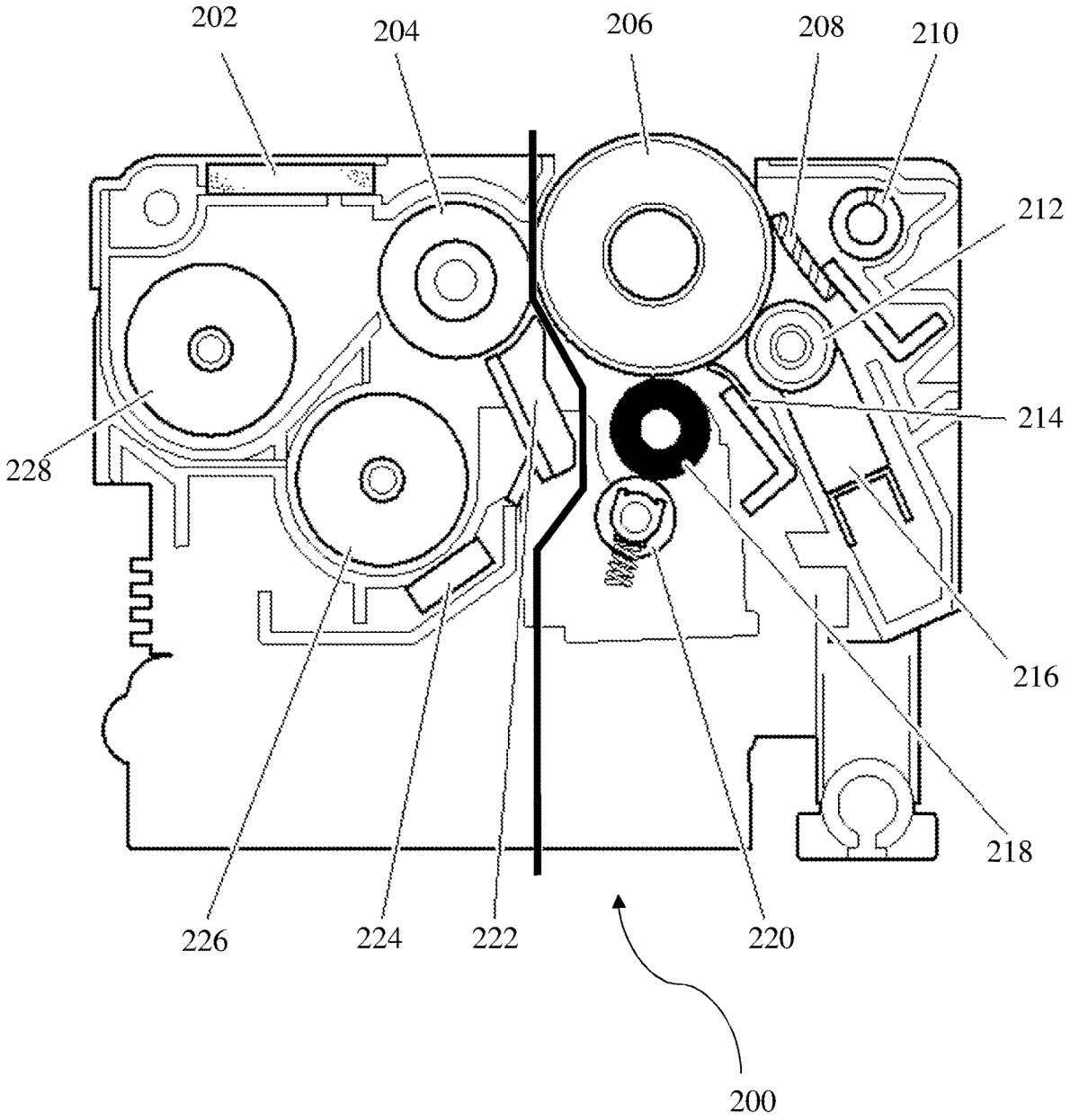
FIG. 2 illustrates a diagram of an exemplary cartridge comprising a developer unit to have its developer converted, consistent with some embodiments of the disclosure.

In step 102, a developer unit of a printer or printer cartridge is provided. For example, the developer unit may be a developer unit of a printer or printer cartridge that contains developer. In some embodiments, the developer unit may be an organic photoconductor (OPC) drum (such as an OPC drum 206 that is shown in FIG. 2). In other embodiments, the developer unit may be any piece, part, or portion of a printer or printer cartridge, such as exemplary printer cartridge 200 in FIG. 2, such that the piece or portion of a toner printer or printer cartridge contains developer that may be removed and cleaned in accordance with the methods disclosed.

In step 104, a mixture of a developer and a first toner is removed from the developer unit. For example, a mixture of the developer and a first toner may be poured out of the developer unit provided in step 102 through a toner port. In some embodiments, the mixture of the developer and the first toner may be removed from the developer unit provided in step 102 through other methods.

In some embodiments, removing the mixture of the developer and the first toner may further comprise removing the developer seal. In other embodiments, removing the mixture of the developer and the first toner may further comprise cleaning the developer unit. In still other embodiments, removing the mixture of the developer and the first toner may further comprise removing the developer seal and cleaning the developer unit.

In step 106, the mixture of the developer and the first toner may be sieved to separate the developer and the first toner. For example, the mixture of developer and the first toner removed from the developer unit in step 104 may be placed into a sieve or similar filtering instrument. In some embodiments, the mixture of developer and the first toner may be place into the sieve in small amounts and separated in batches. In other embodiments, the entirety of the mixture removed from the developer unit may be placed into the sieve at once and separated at once.

In step 108, the first toner is removed from the mixture of the developer and the first toner. For example, a vacuum that is attached to the underside of the sieve, may be used to remove the first toner from the mixture of the developer and the first toner, leaving only the separated developer. In some embodiments, other methods of removing the first toner from the mixture of the developer and the first toner may be used, including but not limited to applying a negative pressure to a sieve or similar instrument to remove either the developer or the first toner and therefore to separate the developer and the first toner. In some embodiments, the removal of the first toner from the mixture of the developer and the first toner is completed when the developer remaining is light gray in color, which is the typical color of metal filings of the separated developer.

The sieving and removing steps 106 and 108 provide for one embodiment of separating the first toner and the developer in the first mixture. The separation of the first toner from the developer may be accomplished in other ways and via other mechanisms, such as filters, magnets, and centrifugation.

In step 110, a second toner is mixed with the separated developer to create a second mixture. For example, the separated developer obtained from removing the first toner from the mixture of developer and first toner in step 108 may then be poured into a mixing bottle with a second toner. The developer and the second toner may then be mixed together. In some embodiments, there may be alternative methods for mixing the developer with the second toner.

In step 112, the second mixture is added into the developer unit. For example, the second mixture obtained from mixing the developer with the second toner in step 110 may be added back into the developer unit. In some embodiments, adding the second mixture into the developer unit may further comprise replacing the developer seal. In some embodiments, the second mixture may be added into the developer unit through a toner port of the developer unit.

FIG. 2 illustrates a diagram of an exemplary cartridge 200 comprising a developer unit to have its developer converted, consistent with some embodiments of the disclosure. The cartridge 200 may include an inner pressure adjustment filter 202, a developer roller 204, an OPC (Organic Photo Conductor) drum 206, a cleaning blade 208, a toner collection coil 210, a lubricant roller 212, a lubricant blade 214, a lubricant bar 216, a charge roller 218, a cleaning roller 220, a doctor blade 222, a toner density (TD) sensor 224, a developer supply coil 226, and a developer collection coil 228.

Figure 3:
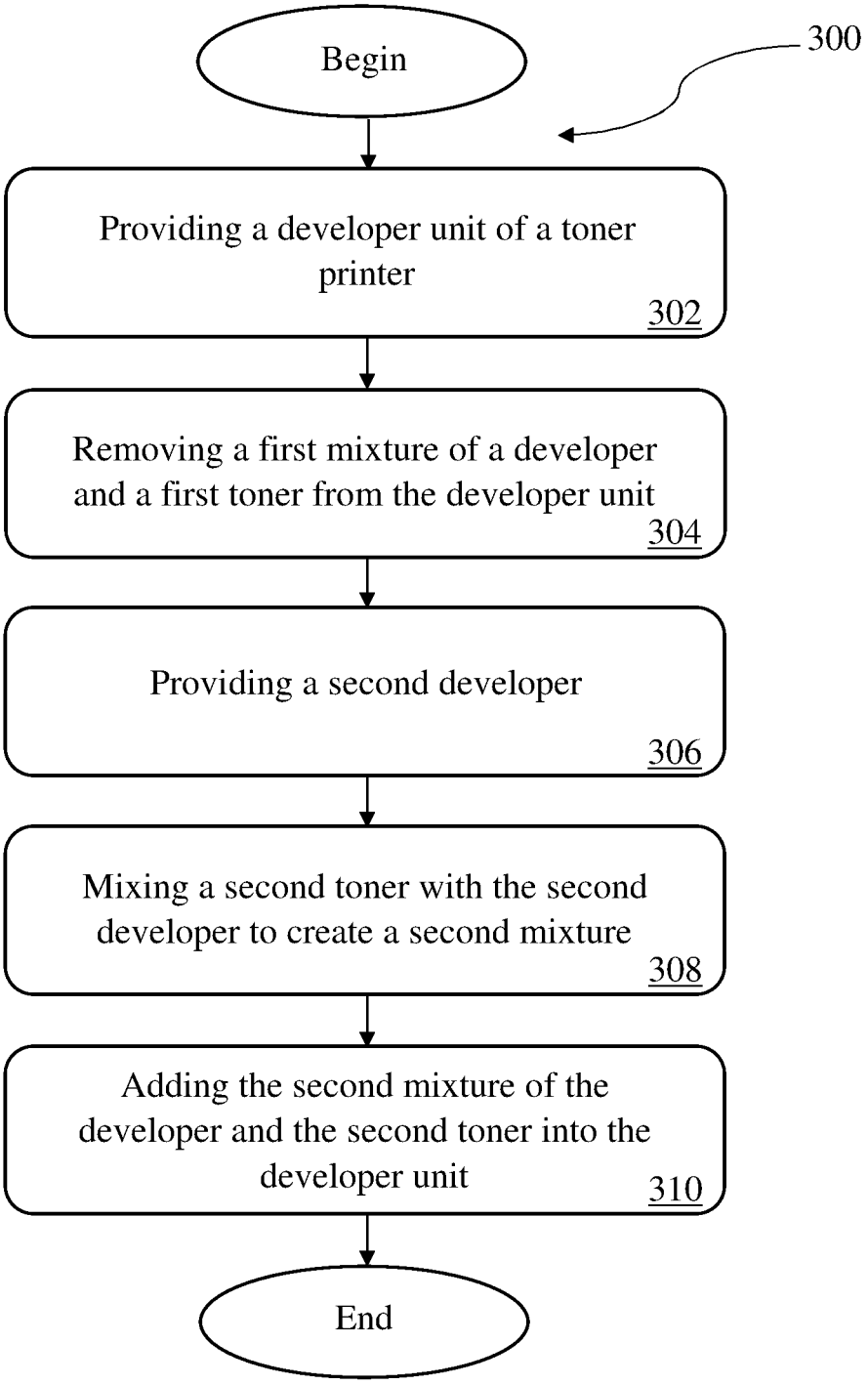
FIG. 3 illustrates a flowchart of another exemplary method for converting developer in a printer cartridge, consistent with some embodiments of the disclosure.

FIG. 3 illustrates a flowchart of another exemplary method 300 for converting developer in a printer cartridge, consistent with some embodiments of the disclosure.

In step 302, a developer unit of a printer or printer cartridge is provided. For example, the developer unit may be a developer unit of a printer or printer cartridge that contains developer. In some embodiments, the developer unit may be an organic photoconductor (OPC) drum such as OPC drum 206 in FIG. 2. In other embodiments, the developer unit may be any piece, part, or portion of a printer or printer cartridge, such as exemplary cartridge 200 in FIG. 2, such that the piece or portion of a printer or printer cartridge contains developer which may be removed and cleaned in accordance with the methods disclosed herein.

In step 304, a mixture of a developer and a first toner is removed from the developer unit. For example, a mixture of the developer and a first toner may be poured out, or otherwise removed from, the developer unit provided in step 302 through a toner port. In some embodiments, the mixture of the developer and the first toner may be removed from the developer unit provided in step 302 in other ways.

In some embodiments, removing the mixture of the developer and the first toner may further comprise removing the developer seal. In other embodiments, removing the mixture of the developer and the first toner may further comprise cleaning the developer unit. In still other embodiments, removing the mixture of the developer and the first toner may further comprise removing the developer seal and cleaning the developer unit.

In step 306, a second (separated) developer is provided. For example, a new (never before used) toner free developer may be provided to replace the original developer.

In step 308, a second toner is mixed with the developer to create a second mixture. For example, the second developer provided in step 306 may then be poured into a mixing bottle with a second toner. The developer and the second toner may then be mixed together. In some embodiments, there may be alternative methods for mixing the developer with the second toner. In some embodiments, a second mixture of a second developer and second toner may be provided in a pre-mixed form.

In step 310, the second mixture is added into the developer unit. For example, the second mixture obtained from mixing the second developer with the second toner in step 308 may be added back into the developer unit. In some embodiments, adding the second mixture into the developer unit may further comprise replacing the developer seal. In some embodiments, the second mixture may be added into the developer unit through a toner port of the developer unit.

Figure 4:
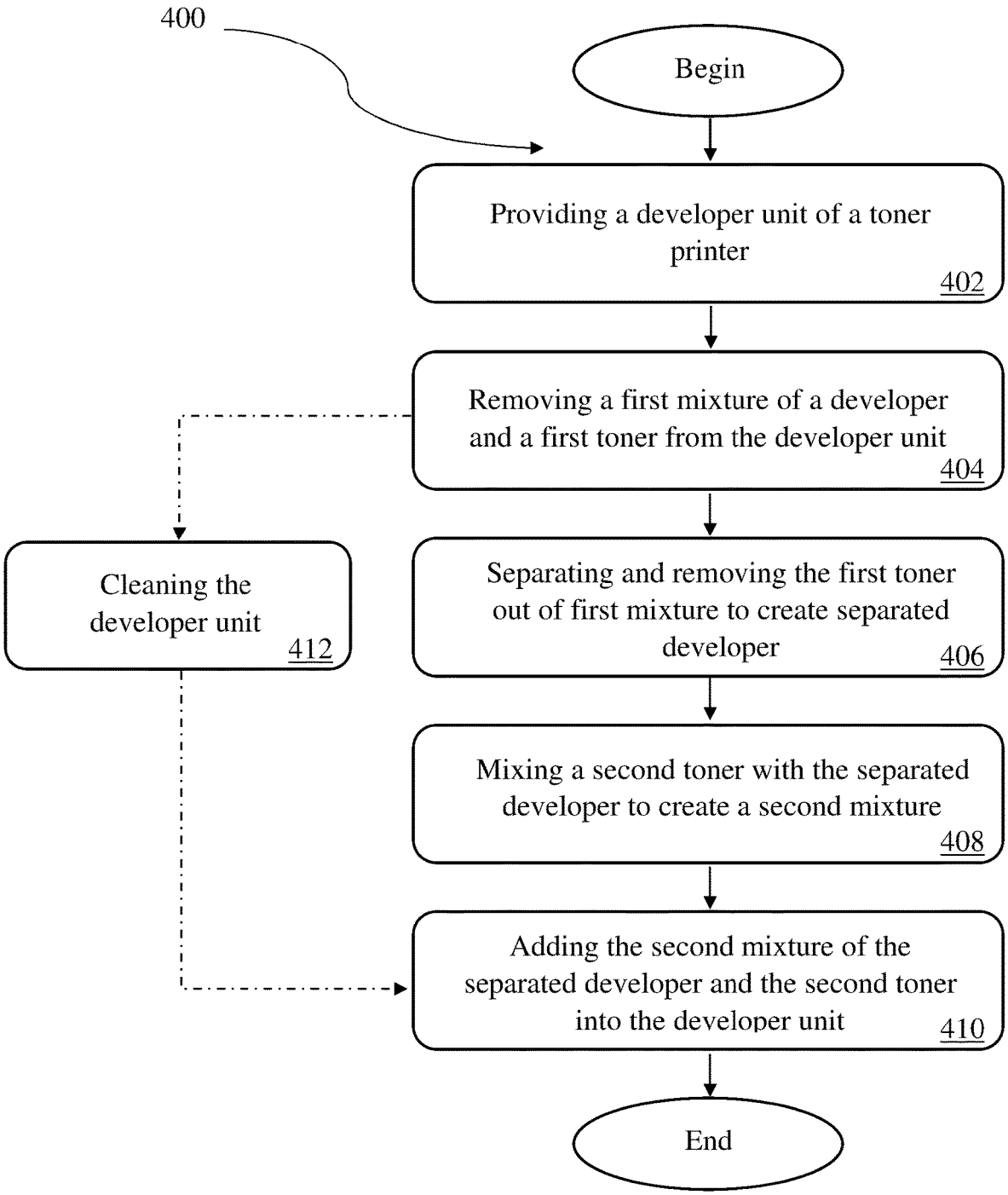
FIG. 4 illustrates a flowchart of another exemplary method for converting developer in a printer cartridge, consistent with some embodiments of the disclosure.

FIG. 4 illustrates a flowchart of another exemplary method 400 for converting developer in a printer cartridge, consistent with some embodiments of the disclosure.

In step 402, a developer unit of a toner printer is provided. For example, the developer unit may be a developer unit of a printer or printer cartridge that contains developer. In some embodiments, the developer unit may be an organic photoconductor (OPC) drum such as OPC drum 206 in FIG. 2. In other embodiments, the developer unit may be any piece, part, or portion of a toner printer or printing cartridge, such as exemplary cartridge 200 in FIG. 2, such that the piece or portion of a printer or printer cartridge contains developer which may be removed and cleaned in accordance with the methods disclosed herein.

In step 404, a mixture of a developer and a first toner is removed from the developer unit. For example, a mixture of the developer and a first toner may be poured out of the developer unit provided in step 402 through a toner port. In some embodiments, the mixture of the developer and the first toner may be removed from the developer unit provided in step 402 through other methods.

In some embodiments, removing the mixture of the developer and the first toner may further comprise removing the developer seal. In other embodiments, removing the mixture of the developer and the first toner may further comprise cleaning the developer unit. In still other embodiments, removing the mixture of the developer and the first toner may further comprise removing the developer seal and cleaning the developer unit.

In step 406, the first toner is removed from the first mixture to create separated developer. For example, the mixture of developer and the first toner removed from the developer unit in step 404 may be placed into a sieve or similar filtering instrument. In some embodiments, the mixture of developer and the first toner may be place into the sieve in small amounts and separated in batches. In other embodiments, the entirety of the mixture removed from the developer unit may be placed into the sieve at once and separated at once.

In step 408, a second toner is mixed with the separated developer to create a second mixture. For example, the separated developer created in step 406 may then be poured into a mixing bottle with a second toner. The separated developer and the second toner may then be mixed together. In some embodiments, there may be alternative methods for mixing the developer with the second toner. In some embodiments, a second mixture of a separated developer and second toner may be provided in a pre-mixed form.

In step 410, the second mixture is added into the developer unit. For example, the second mixture obtained from mixing the separated developer with the second toner in step 408 may be added back into the developer unit. In some embodiments, adding the second mixture into the developer unit may further comprise replacing the developer seal. In some embodiments, the second mixture may be added into the developer unit through a toner port of the developer unit.

In optional step 412, the developer unit is cleaned. For example, after removing a first mixture of a developer and a first toner from the developer unit in step 404 and before adding the second mixture of the separated developer and the second toner into the developer unit in step 410, the developer unit may have its developer chamber cleaned. The developer chamber may be blown clean using a blowing device or vacuum. The cleaning of the developer unit may also include avoiding static discharges on any microchips in the developer unit. Cleaning the developer unit may additionally comprise bending a retaining blade for a magnetic roller associated with the developer unit. The retaining blade may be bent by running a finger, a wood stem of a cotton swab, or other similar instrument across the retaining blade at least one time to create a slight bend and distance the retaining blade from the roller. Cleaning the developer unit may also include avoiding any accumulation or deposit of oils, including bodily oils, on the roller or other parts of the developer unit.

Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain. The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A method of converting developer in a printer cartridge, comprising the steps:

providing a developer unit of a printer cartridge;

removing a first mixture of a developer and a first toner from said developer unit;

sieving said first mixture of said developer and said first toner;

removing said first toner from said first mixture of said developer and said first toner, such that a separated developer is created;

mixing a second toner with said separated developer to create a second mixture of said separated developer and said second toner, wherein said second toner is a different toner than said first toner;

wherein said second toner is a different color than said first toner; and adding said second mixture into said developer unit.

2. The method of claim 1, wherein said first toner is removed via a vacuum.

3. The method of claim 1, further comprising cleaning said developer unit after said first mixture is removed and before said second mixture is added.

4. The method of claim 1, wherein said first toner is a toner selected from the group of toners consisting of: a yellow toner, a white toner; and a black toner.

5. The method of claim 1, wherein said second toner is a toner selected from the group of toners consisting of: a cyan toner; and a magenta toner.

6. The method of claim 1, wherein said first toner is a sublimation toner.

7. The method of claim 1, wherein said second toner is a sublimation toner.

8. The method of claim 1, wherein said first toner is a fluorescent toner.

9. The method of claim 1, wherein said second toner is a fluorescent toner.

10. A method of converting developer in a printer cartridge, comprising the steps:

providing a developer unit of a printer cartridge;

removing a developer cover from said developer unit;

removing a first mixture of a developer and a first toner from said developer unit;

sieving said first mixture of said developer and said first toner;

removing said first toner from said first mixture of said developer and said first toner, such that a separated developer is created;

mixing a second toner with said separated developer to create a second mixture of said separated developer and said second toner, wherein said second toner is a different toner than said first toner;

wherein said second toner is a different color than said first toner;

adding said second mixture into said developer unit of said toner printer; and replacing said developer cover onto said developer unit.

11. The method of claim 10, wherein said first toner is removed via a vacuum.

12. The method of claim 10, further comprising cleaning said developer unit after said first mixture is removed and before said second mixture is added.

13. The method of claim 10, wherein said first toner is a toner selected from the group of toners consisting of: a yellow toner, a white toner; and a black toner.

14. The method of claim 10, wherein said second toner is a toner selected from the group of toners consisting of: a cyan toner; and a magenta toner.

15. The method of claim 10, wherein said second toner is a sublimation toner.

16. The method of claim 10, wherein said second toner is a fluorescent toner.

17. A method of converting developer in a printer cartridge, comprising the steps:

providing a developer unit of a printer cartridge;

removing a first mixture of a first developer and a first toner from said developer unit;

providing a second mixture that comprises a second developer and a second toner;

wherein said second toner is a different color than said first toner; and adding said second mixture into said developer unit.

18. The method of claim 17, further comprising cleaning said developer unit after said first mixture is removed and before said second mixture is added.

19. A method of converting developer in a printer cartridge, comprising the steps:

providing a developer unit of a printer cartridge;

removing a first mixture of a developer and a first toner from said developer unit;

separating and removing said first toner out of said first mixture, such that a separated developer is created;

mixing a second toner with said separated developer to create a second mixture of said separated developer and said second toner, wherein said second toner is a different color than said first toner; and adding said second mixture into said developer unit.

20. The method of claim 19, further comprising cleaning said developer unit after said first mixture is removed and before said second mixture is added.

* * * * *